US009785115B2

(12) United States Patent
Philippon et al.

(10) Patent No.: US 9,785,115 B2
(45) Date of Patent: Oct. 10, 2017

(54) TIMEPIECE MOVEMENT COMPRISING A DATE CORRECTION MECHANISM

(71) Applicant: ETA SA Manufacture Horlogere Suisse, Grenchen (CH)

(72) Inventors: David Philippon, Saint Imier (CH); Olivier Mertenat, Solothurn (CH); Baptist Wyssbrod, Nidau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/226,254

(22) Filed: Aug. 2, 2016

(65) Prior Publication Data

US 2017/0075304 A1 Mar. 16, 2017

(30) Foreign Application Priority Data

Sep. 15, 2015 (EP) ..... 15185349

(51) Int. Cl.
*G04B 3/00* (2006.01)
*G04B 19/25* (2006.01)

(52) U.S. Cl.
CPC ..... *G04B 3/003* (2013.01); *G04B 19/25* (2013.01)

(58) Field of Classification Search
CPC ..... G04B 3/003; G04B 19/25
(Continued)

(56) References Cited

U.S. PATENT DOCUMENTS 3,597,916 A 8/1971 Nakagawa
3,775,966 A 12/1973 Matsuura
(Continued)

FOREIGN PATENT DOCUMENTS

CH 520 968 3/1972
CH 706 266 A2 9/2013
(Continued)

OTHER PUBLICATIONS

European Search Report issued May 9, 2016 in European Application 15185349.6 filed on Sep. 15, 2015 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

A timepiece movement including a first lever bearing a first drive wheel, a second lever bearing a second wheel for time setting, and a third lever bearing a date correction mechanism. The third lever is mounted to pivot on the second lever and arranged to move between a meshing position, in which the date correction mechanism cooperates with the date display mechanism, and a retraction position, in which the date correction mechanism is disconnected from the date display mechanism. The first and second levers are arranged to occupy at least one date correction position, in which the first drive wheel is kinematically connected to the date correction mechanism and is not kinematically connected to the second wheel for time setting, and a time setting position, in which the first drive wheel is kinematically connected to the second wheel for time setting and is not kinematically connected to the date correction mechanism, wherein the position of the second lever is modified by cooperation between the first lever and the second lever.

10 Claims, 6 Drawing Sheets

(58) Field of Classification Search
USPC ..... 368/213, 18, 31–32, 35–37, 89, 97–106, 368/112, 185, 190–199
See application file for complete search history.

(56) References Cited

U.S. PATENT DOCUMENTS

| | | | | |
|---|---|---|---|---|
| 3,892,067 | A | 7/1975 | Meylan-Piguet | |
| 7,170,824 | B2 * | 1/2007 | Wilmouth | G04B 19/241 368/18 |
| 7,625,116 | B2 * | 12/2009 | Bron | G04B 19/25 368/101 |
| 7,957,226 | B2 * | 6/2011 | Chaignat | G04B 13/02 368/185 |

FOREIGN PATENT DOCUMENTS

| | | |
|---|---|---|
| EP | 2 214 066 A1 | 8/2010 |
| EP | 2 707 778 B1 | 3/2014 |
| FR | 2144826 | 2/1973 |
| GB | 1 471 359 | 4/1977 |

* cited by examiner

TIMEPIECE MOVEMENT COMPRISING A DATE CORRECTION MECHANISM

This application claims priority from European Patent application 15185349.6 of Sep. 15, 2015, the entire disclosure of which is hereby incorporated herein by reference.

FIELD OF THE INVENTION

The invention relates to the field of mechanical horology. More particularly, it relates to a timepiece movement comprising a control stem, a winding mechanism for winding the movement, a date display mechanism and a time display mechanism.

BACKGROUND OF THE INVENTION

Numerous mechanical watches classically comprise a control stem arranged at 3 o'clock and capable of occupying two positions, i.e. a manual winding position and a time setting position. These watches can also comprise a data display mechanism. A rapid correction of the date is performed by means of a pushbutton provided on the watch case at a different position from the control stem, e.g. at 10 o'clock. However, this configuration requires provision of an opening in the case for the pushbutton to pass through, and this has the disadvantage of weakening the seal of the watch and limiting the choice in decorative designs of the watch.

A solution to solve these problems is proposed in patent EP 2 707 778 and consists of correcting the date by means of the control stem that is then arranged to occupy a third position. However, in this mechanism the corrector element for the date is fixed and therefore permanently meshed with the day date ring and the correction of the date is conducted in two directions. There is a risk of breaking the date driver arm if the user performs a correction of the date at around midnight. Moreover, the wheel of the second wheel set carried by the second lever meshes permanently with the pinion carried by the first lever, the connection between these parts being assured by their respective toothing. This construction requires a specific cut of these toothing arrangements so that they have a concentric profile to prevent any blocking.

SUMMARY OF THE INVENTION

The object of the invention is to remedy the different disadvantages of the known mechanisms.

More precisely, an object of the invention is to provide a timepiece movement that allows a rapid correction of the date by the control stem and requires no opening in the case relating to the pushbutton that was previously necessary to conduct this function.

It is also an object of the invention to provide a timepiece movement that allows a unidirectional correction of the date by the control stem.

For this, the present invention relates to a timepiece movement comprising a control stem, a winding mechanism for winding the movement, a date display mechanism and a time display mechanism.

According to the invention the timepiece movement comprises a first lever bearing a first drive wheel capable of being kinematically connected to the control stem, a second lever bearing a second wheel for time setting arranged to cooperate with the time display mechanism and capable of being kinematically connected to the first drive wheel, and a third lever bearing a date correction mechanism capable of being kinematically connected to the first drive wheel and also to the date display mechanism, wherein said third lever is mounted to pivot on the second lever and arranged to move between a meshing position, in which the date correction mechanism cooperates with the date display mechanism, and a retraction position, in which the date correction mechanism is disconnected from the date display mechanism, and the control stem and said first and second levers are arranged to occupy three positions:

- a winding position, in which the control stem is kinematically connected to the winding mechanism for winding the movement and is not kinematically connected to the first drive wheel,
- a date correction position, in which the control stem is kinematically connected to the first drive wheel and the first and second levers are positioned so that said first drive wheel is kinematically connected to the date correction mechanism and is not kinematically connected to the second wheel for time setting,
- and a time setting position, in which the control stem is kinematically connected to the first drive wheel and the first and second levers are positioned so that said first drive wheel is kinematically connected to the second wheel for time setting and is not kinematically connected to the date correction mechanism,
- wherein the position of the first lever is modified by cooperation between the control stem and the first lever and the position of the second lever is modified by cooperation between the first lever and the second lever.

Advantageously, the first lever can bear a positioning pin arranged to cooperate with the second lever, the cooperation between said positioning pin and the second lever defining the position of said second lever.

A return spring can preferably be provided that is arranged to cooperate with the second lever and ensure contact between said second lever and the first lever.

Advantageously, the second lever can additionally bear a connecting wheel set comprising a third connecting wheel capable of being kinematically connected to the first drive wheel and a connecting pinion cooperating with the date correction mechanism.

The second lever can preferably comprise a first staff at one end, on which the second wheel for time setting is mounted, and a second staff at a second end, on which are mounted the third lever and also the connecting wheel set, this being fixed to said second staff.

Advantageously, the third lever can comprise a support arm, on which the date correction mechanism is mounted to pivot, and an arm bearing a stop element.

A support element can preferably be provided that is arranged to rest on the stop element of the third lever when the control stem and the first and second levers are in time setting position in order to cause the third lever to pivot into its retraction position disconnected from the date display mechanism.

Advantageously, the date correction mechanism can comprise a fourth correction wheel capable of being kinematically connected to the first drive wheel and a corrector element actuated by said fourth correction wheel and comprising at least one correction finger capable of cooperating with the date display mechanism.

The third lever can preferably be frictionally mounted on the second staff of the second lever in order to be fixed to the second staff during correction of the date to occupy the meshing position with the date display mechanism when the control stem is turned in one direction and occupy its retraction position disconnected from the date display mechanism when the control stem is turned in the other direction and in order to be disengaged from the second staff during the time setting to pivot into the retraction position disconnected from the date display mechanism when its stop element cooperates with the support element.

Advantageously, a holding plate can be provided that has an opening for defining the path of the third lever.

The timepiece movement comprising a date correction mechanism according to the invention allows a rapid and unidirectional correction of the date by means of the control stem without any risk of breaking an element of the day date mechanism when correcting the date at around midnight. No specific cutting of the toothing arrangements of the wheels and pinions used is necessary.

BRIEF DESCRIPTION OF THE DRAWINGS

Other features and advantages of the invention will become clearer on reading the following description of a particular embodiment of the invention given as a simple non-restrictive illustrative example and the attached drawings.

DETAILED DESCRIPTION OF THE INVENTION

Figure 1:
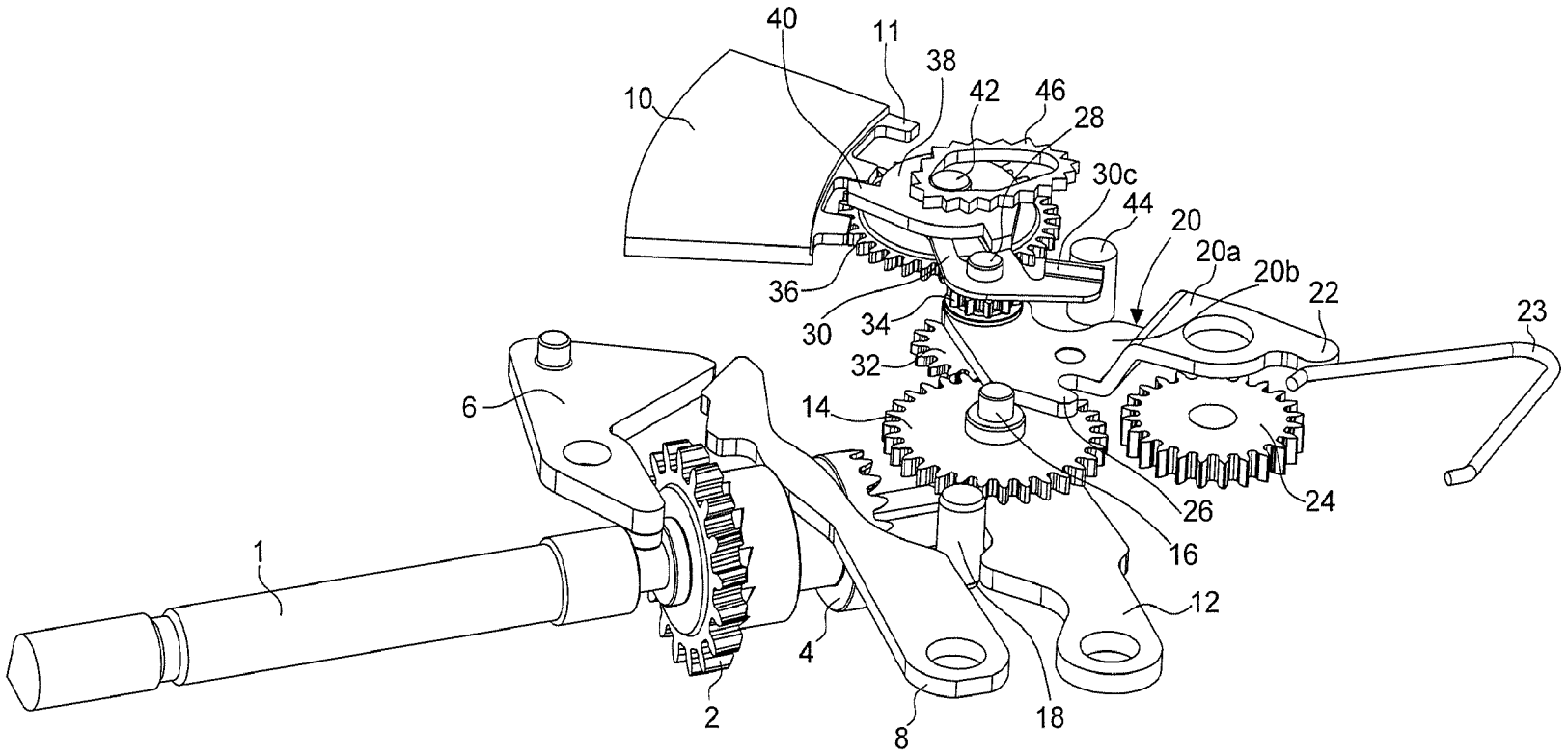
FIG. 1 is an isometric view of part of the mechanisms provided in a movement according to the invention.

FIG. 1 shows a part of a timepiece movement comprising in particular a control stem 1, a winding mechanism, a date display mechanism and a time display mechanism.

Classically, the control stem 1 or winder stem is operable from outside the case of the movement and is movable both rotatably and in translation to occupy its different positions. A winding pinion 2 and a sliding pinion 4 are also provided, the positioning of the sliding pinion 4 being assured by a pull-out piece 6 and a lever 8.

Figure 3:
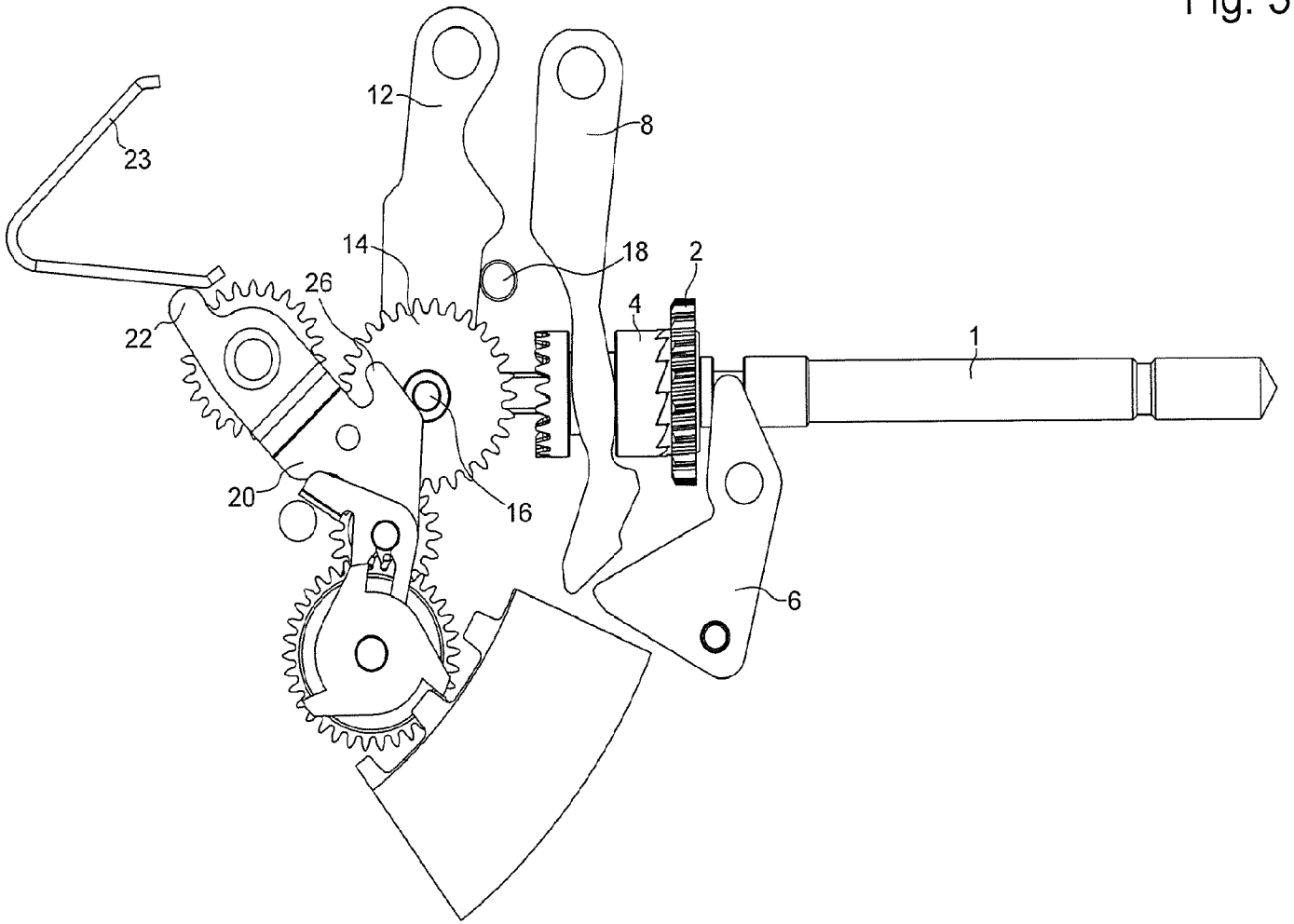
FIG. 3 is a front view of the mechanisms shown in FIG. 1 in a manual winding position.

Classically, the winding pinion 2 meshes with the winding mechanism (not shown) to conduct the manual winding of the movement when the control stem occupies its winding position (in general, the position where it is not pulled out) and when the sliding pinion 4 cooperates with the winding pinion 2, as shown in FIG. 3.

The date display mechanism classically comprises a day date disc or ring 10 having an inside toothing 11 that can be actuated by a day date mechanism.

The time display mechanism can comprise an intermediate wheel assembly meshing with the dial-train wheel, which cooperates with the cannon-pinion.

All these elements and their operation are known to a person skilled in the art and do not require more detailed description.

According to the invention a first lever 12 is provided that is mounted to pivot on the frame and bears a first drive wheel 14 mounted to freely rotate around a staff formed by a pin 16. This pin 16 is a positioning pin, the role of which will be explained below. The first drive wheel 14 allows the sliding pinion 4 of the control stem 1 to mesh therewith when the control stem is in correction or time setting position (pulled-out positions). Another pin 18 is provided on the frame and forms a stop for the first lever 12.

Figure 4:
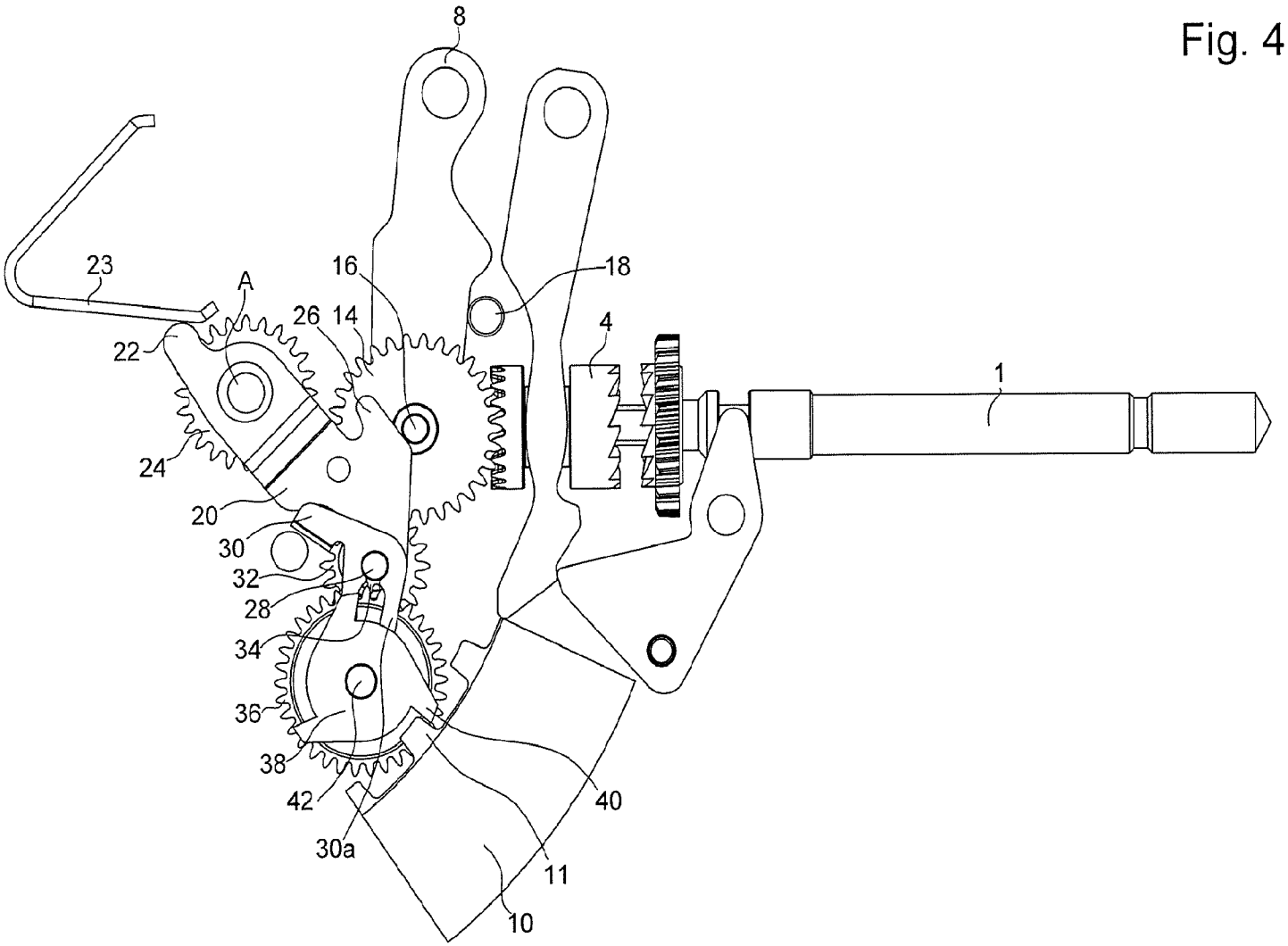
FIG. 4 is a front view of the mechanisms shown in FIG. 1 in date correction position, wherein the third lever is in its meshing position.

A second lever 20 mounted to pivot on the frame is also provided. With reference most particularly to FIGS. 1 and 4, the second lever 20 comprises a first arm 20*a* traversed at its free end by a first staff A forming the pivot axis A of the second lever 20 on the frame. The first arm 20 terminates with a first nose 22. The first nose 22 is arranged to cooperate with a return spring 23 provided on the frame. Said return spring 23 is arranged to cooperate with the second lever 20 by means of the first nose 22 and to assure contact between said second lever 20 and the first lever 12.

A second wheel for time setting 24 is mounted to freely rotate on the pivot axis A and is arranged to cooperate permanently with the time display mechanism and more specifically with one of the elements of the intermediate wheel assembly. The second wheel for time setting 24 is able to be kinematically connected to the first drive wheel 14.

The second lever 20 also comprises a second arm 20*b* that has a second nose 26 laterally on the side of the first lever 12. The second nose 26 is arranged to cooperate with the positioning pin 16 provided on the first lever 12, wherein the cooperation between said positioning pin 16 and the second nose 26 defines the position of the second lever 20.

At its free end the second arm 20*b* bears a second staff 28, on which a connecting wheel set as well as a third lever 30 are mounted. The connecting wheel set comprises a third connecting wheel 32 that is able to be kinematically connected to the first drive wheel 14 and a connecting pinion 34 arranged to cooperate with the date correction mechanism. The third connecting wheel 32 and the connecting pinion 34 are fixedly mounted on the second staff 28. The third lever 30 is frictionally mounted on the second staff 28, as will be explained below.

Figure 2:
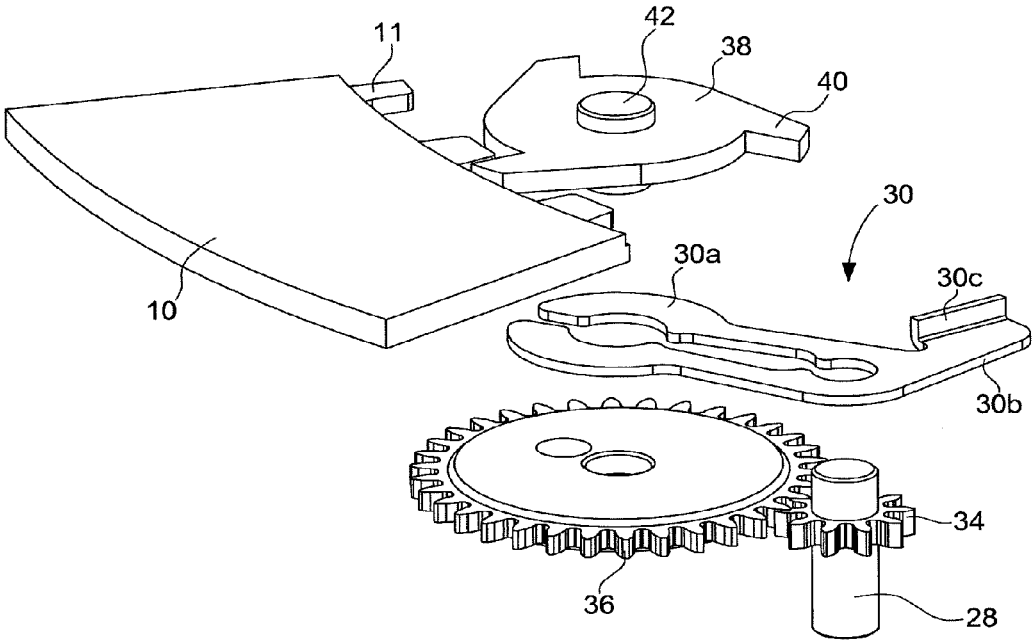
FIG. 2 is an exploded view of the third lever, the date correction mechanism and the date display mechanism.

The third lever 30 bears a date correction mechanism that is capable of being kinematically connected to the first drive wheel 14 and also to the day date ring 10. With reference most particularly to FIG. 2, the date correction mechanism comprises a fourth correction wheel 36 that is capable of being kinematically connected to the first drive wheel 14 via the connecting pinion 34 and the connecting wheel 32, and a corrector element 38 comprising correction fingers 40 capable of cooperating with the inside toothing 11 of the day date ring 10. The corrector element 38 is frictionally mounted on the correction wheel 36 by means of a staff 42 fixed to the corrector element 38. In normal operation the corrector element 38 and the fourth correction wheel 36 are fixed, and the assembly is mounted to be rotatably movable on the third lever 30.

In the shown example the correction fingers cooperate directly with the day date disk, but it is clear that wheel trains or other intermediate mechanisms can be provided between the corrector element 38 and the time display mechanism.

The third lever 30 comprises a support arm 30*a*, and mounted on this arm to traverse it are staff 42 for mounting the date correction mechanism on the third lever 30 and also staff 28 for mounting the third lever 30 on the second lever 20. The third lever 30 is mounted to pivot on the second lever 20 and is arranged to move between a meshing position, in which the date correction mechanism cooperates with the day date ring 10, and a retraction position, in which the date correction mechanism is disconnected from the day date ring 10.

The third lever 30 also comprises an arm 30*b* bearing a stop element 30*c*.

A support element 44 is additionally provided on the frame and is arranged to rest on the stop element 30*c* of the third lever 30 to cause the third lever 30 to pivot into its retraction position disconnected from the date display mechanism, as will be described below.

A holding plate 46 is also provided on the frame that has an opening and is arranged in such a way in relation to the corrector element 38 that the staff 42 of the date correction mechanism circulates freely in the opening, wherein the edges of said opening thus allow the path of the third lever 30 to be defined.

The operation of the movement according to the invention is as follows: in manual winding position, as shown in FIG. 3, the sliding pinion 4 meshes with the winding pinion 2, which meshes with the winding mechanism (not shown) to conduct the manual winding of the movement. Thus, the control stem 1 occupying its winding position is kinematically connected to the winding mechanism of the movement and is not kinematically connected to the first drive wheel 14 nor therefore to the other time or date display mechanisms. The first lever 12 is in abutment against the pin 18. The return spring 23 resting on the nose 22 assures contact of the nose 26 of the second lever 20 with the pin 16 fixed to the first lever 12.

With reference to FIG. 4, when the control stem 1 is pulled out into its date correction position, the sliding pinion 4 performs a translatory movement towards the first drive wheel 14 and then meshes with this. The first lever 12 is in abutment against the pin 18. The return spring 23 resting on the nose 22 assures contact of the nose 26 of the second lever 20 with the pin 16 fixed to the first lever 12. In this date correction position the control stem is thus kinematically connected to the first drive wheel 14 and the first 12 and second 20 levers are positioned so that the first drive wheel 14 is kinematically connected to the date correction mechanism borne by the third lever 30 and is not connected kinematically to the second wheel for time setting 24. More precisely, the second lever 20 is positioned so that the first drive wheel 14 meshes with the third connecting wheel 32 borne by said second lever 20. The connecting pinion 34 fixed to the third connecting wheel 32 is then driven to rotate and meshes with the fourth correction wheel 36 borne by the third lever 30 so that the corrector element 38 fixed to said fourth correction wheel 36 is driven to rotate so that one of the correction fingers 40 cooperates with a tooth 11 of the day date ring 10 and actuates the latter to correct the date. The second lever 20 is positioned so that the first drive wheel 14 does not cooperate with the second wheel for time setting 24. Thus, the function of rapid date correction is separated from the time setting and winding functions.

In this position the third lever 30 is fixed to the staff 28 bearing the connecting wheel set (third connecting wheel 32 and connecting pinion 34). Thus, the rotation of the control stem 1 in one direction causes the connecting wheel set and the staff 28 to rotate in one direction, and therefore the third lever 30 to pivot in the same direction, wherein this direction of pivoting motion, for example, moves the arm 30*a* of the third lever 30 and therefore the date correction mechanism towards the day date ring 10, as shown in FIG. 4. The third lever 30 then occupies its meshing position with the day date ring 10. The displacement of the date correction mechanism towards the day date ring 10, and therefore the meshing between the correction element 38 and the day date ring 10, is assisted by the edges of the opening provided in the holding plate 46. It is then possible to conduct the date correction.

Figure 5:
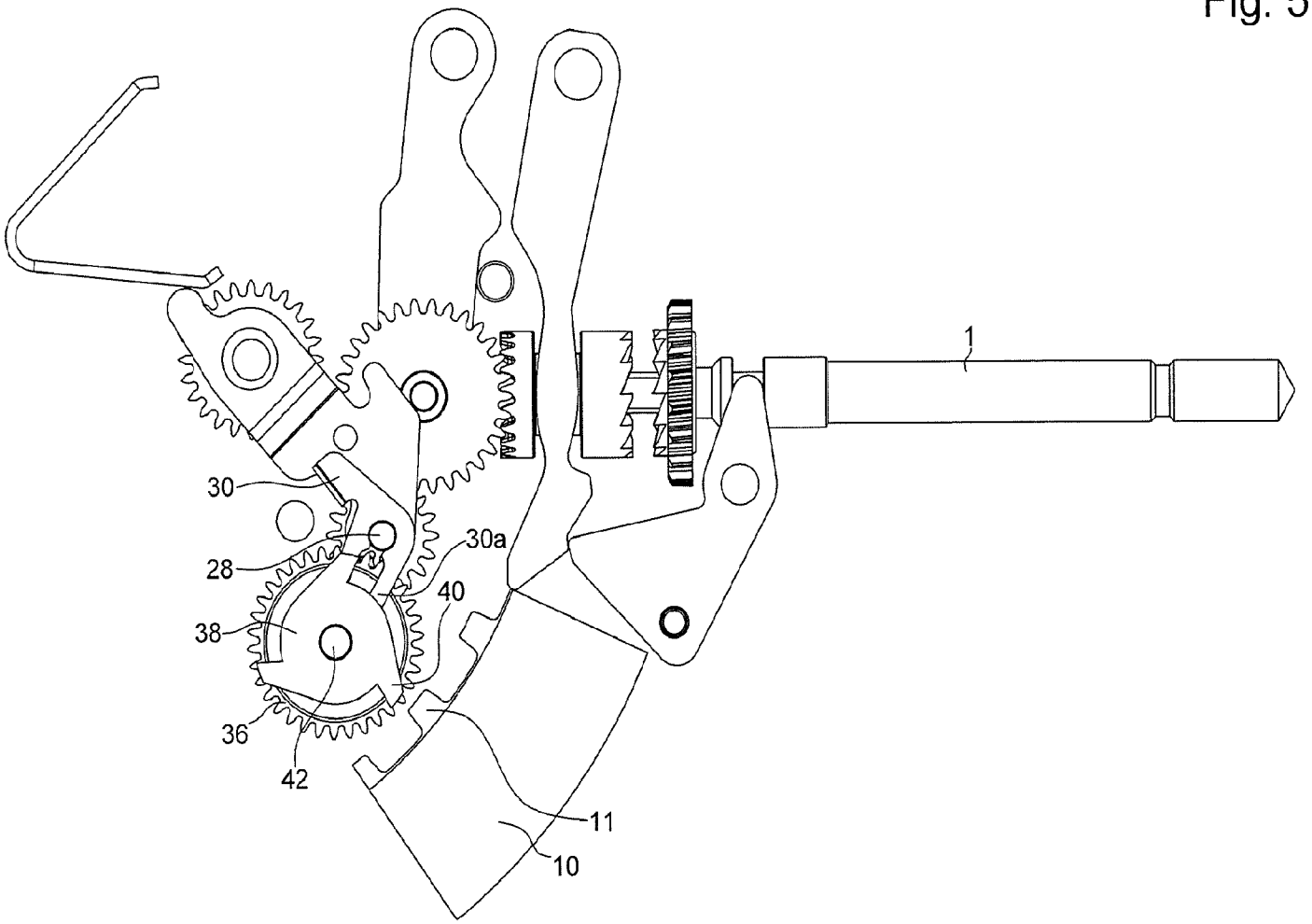
FIG. 5 is a front view of the mechanisms shown in FIG. 1 in date correction position, wherein the third lever is in its retraction position.

When the control stem 1 is turned in the opposite direction, this causes the rotation of the connecting wheel set and the staff 28 in said opposite direction, and therefore the third lever 30 to pivot in the same opposite direction, and this opposite direction of the pivoting motion moves the arm 30*a* of the third lever 30, and therefore the date correction mechanism, away from the day date ring 10, as shown in FIG. 5. The third lever 30 then occupies its retraction position disconnected from the day date ring 10. The movement of the date correction mechanism away from the day date ring 10 is limited by the edges of the opening provided in the holding plate 46. Since the date correction mechanism is disconnected from the day date ring 10, date correction is thus no longer possible even if the control stem is actuated.

Thus, the mechanism according to the invention allows a unidirectional correction of the date by means of the control stem.

In the cases where the third lever 30 has remained in meshing position, in which the correction element 38 meshes with the day date ring 10, the frictional mounting of said correction element 38 on the fourth correction wheel 36 allows said correction element 38 to be disengaged from said fourth correction wheel 36 and to cause it to pivot under the pressure of the day date ring 10 during the normal date change.

Figure 6:
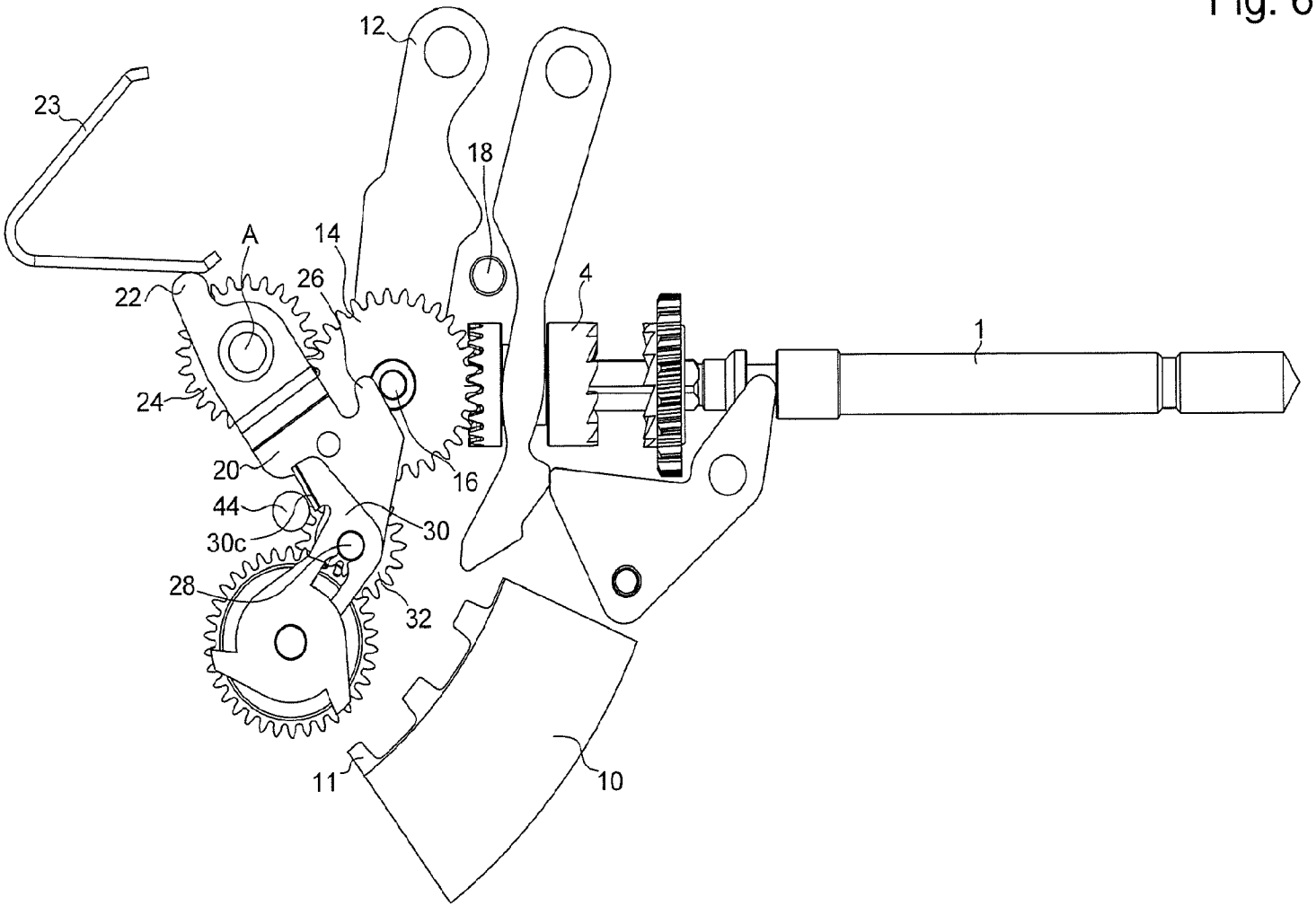
FIG. 6 is a front view of the mechanisms shown in FIG. 1 in time setting position.

With reference to FIG. 6, when the control stem 1 is once again pulled out into its time setting position, the sliding pinion 4 performs a new translation movement in the direction of the first lever 12. The control stem 1 then cooperates with the first lever 12, so that the latter pivots in the direction of the second lever 20 such that the first drive wheel 14 meshes with the second wheel for time setting 24, the sliding pinion 4 still meshing with the first drive wheel 14. The return spring 23 resting on the nose 22 assures contact of the nose 26 of the second lever 20 with the pin 16 fixed to the first lever 12. In this time setting position the control stem 1 is thus connected kinematically to the first drive wheel 14, and the first 12 and second 20 levers are positioned so that the first drive wheel 14 is connected kinematically to the second wheel for time setting 24 to allow the time setting operation and is not connected kinematically to the date correction mechanism borne by the third lever 30. More precisely, during the tipping of the first lever 12 the cooperation between the pin 16 and the second lever 20 caused the second lever 20 to tip around the axis A, which moves from its date correction position to its time setting position so that the third connecting wheel 32 borne by said second lever 20 disengages from the first drive wheel 14. Thus, the time setting function is separated from the rapid date correction and winding functions.

When the second lever 20 tips into its time setting position, the stop element 30*c* of the third lever 30 rests on the support element 44 so that, because of the frictional mounting, the third lever 30 is disengaged from the staff 28 and pivots into its retraction position disconnected from the day date ring 10, as shown in FIG. 6. The positioning of the third lever in its retraction position ensures that the date correction mechanism does not cooperate with the day date ring 10 during the time setting operation.

In the movement according to the invention the meshing between the first drive wheel and the date display or time setting mechanisms is not permanent, and therefore the toothing arrangements of the different pieces do not require specific cutting. The meshing between the first drive wheel and the date display or time setting mechanism is controlled by the positioning of the first lever 12 and the second lever 20 in contact with the pin 16 of said first lever 12, wherein the return spring 23 guarantees the contact between said first and second levers 12 and 20.

Moreover, the proposed mechanism is compact and has a small space requirement. Within the framework of a movement comprising a chronograph mechanism, it advantageously allows sufficient space to be left to arrange the minute counter mechanism at 3 o'clock close to the control stem.

What is claimed is:

1. A timepiece movement comprising a control stem, a winding mechanism for winding the movement, a date display mechanism and a time display mechanism, wherein the timepiece movement comprises a first lever bearing a first drive wheel capable of being kinematically connected to the control stem, a second lever bearing a second wheel for time setting arranged to cooperate with the time display mechanism and capable of being kinematically connected to the first drive wheel, and a third lever bearing a date correction mechanism capable of being kinematically connected to the first drive wheel and also to the date display mechanism, wherein said third lever is mounted to pivot on the second lever and arranged to move between a meshing position, in which the date correction mechanism cooperates with the date display mechanism, and a retraction position, in which the date correction mechanism is disconnected from the date display mechanism, and wherein the control stem and said first lever and said second lever are arranged to occupy three positions:

a winding position, in which the control stem is kinematically connected to the winding mechanism for winding the movement and is not kinematically connected to the first drive wheel, a date correction position, in which the control stem is kinematically connected to the first drive wheel, and the first lever and the second lever are positioned so that said first drive wheel is kinematically connected to the date correction mechanism and is not kinematically connected to the second wheel for time setting, and a time setting position, in which the control stem is kinematically connected to the first drive wheel and the first lever and the second lever are positioned so that said first drive wheel is kinematically connected to the second wheel for time setting and is not kinematically connected to the date correction mechanism, wherein the position of the first lever is modified by cooperation between the control stem and the first lever and the position of the second lever is modified by cooperation between the first lever and the second lever.

2. The timepiece movement according to claim 1, wherein the first lever bears a positioning pin arranged to cooperate with the second lever, the cooperation between said positioning pin and the second lever defining the position of said second lever.

3. The timepiece movement according to claim 1, wherein a return spring is provided and is arranged cooperate with the second lever and to ensure contact between said second lever and the first lever.

4. The timepiece movement according to claim 1, wherein the second lever additionally bears a connecting wheel set comprising a third connecting wheel capable of being kinematically connected to the first drive wheel and a connecting pinion cooperating with the date correction mechanism.

5. The timepiece movement according to claim 4, wherein the second lever comprises, at one end, a first staff, on which the second wheel for time setting is mounted, and, at a second end, a second staff, on which are mounted the third lever and also the connecting wheel set, being fixed to said second staff.

6. The timepiece movement according to claim 1, wherein the third lever comprises a support arm, on which the date correction mechanism is mounted to pivot, and an arm bearing a stop element.

7. The timepiece movement according to claim 6, wherein a support element is provided that is arranged to rest on the stop element of the third lever when the control stem and the first lever and the second lever are in time setting position in order to cause the third lever to pivot into its retraction position disconnected from the date display mechanism.

8. The timepiece movement according to claim 1, wherein the date correction mechanism comprises a fourth correction wheel capable of being kinematically connected to the first drive wheel and a corrector element actuated by said fourth correction wheel and comprising at least one correction finger capable of cooperating with the date display mechanism.

9. The timepiece movement according to claim 5, wherein the third lever is frictionally mounted on the second staff of the second lever in order to be fixed to the second staff during correction of the date to occupy the meshing position with the date display mechanism, when the control stem is turned in one direction, and occupy its retraction position disconnected from the date display mechanism, when the control stem is turned in the other direction, and in order to be disengaged from the second staff during the time setting to pivot into the retraction position disconnected from the date display mechanism when its stop element cooperates with a support element.

10. The timepiece movement according to claim 1, wherein a holding plate is provided that has an opening for defining the path of the third lever.

* * * * *